United States Patent [19]

Dehne

[11] Patent Number: 4,616,570

[45] Date of Patent: Oct. 14, 1986

[54] POWER AND FREE CONVEYOR SYSTEMS

[75] Inventor: Clarence A. Dehne, Farmington Hills, Mich.

[73] Assignee: Jervis B. Webb Company, Farmington Hills, Mich.

[21] Appl. No.: 542,257

[22] Filed: Oct. 14, 1983

Related U.S. Application Data

[63] Continuation-in-part of Ser. No. 272,381, Jun. 10, 1981, abandoned.

[51] Int. Cl.[4] ..... B61B 10/00

[52] U.S. Cl. ..... 104/172 B; 104/88

[58] Field of Search ..... 104/172 B, 172 BT, 172 S, 104/96, 88, 89, 178; 105/148, 150

[56] References Cited

U.S. PATENT DOCUMENTS

| | | | |
|---|---|---|---|
| 2,987,011 | 6/1961 | Melmer | 104/172 B |
| 3,229,645 | 1/1966 | Dehne | 104/172 S |
| 3,230,897 | 1/1966 | Orwin | 104/172 |
| 3,242,874 | 3/1966 | Orwin | 104/96 |
| 3,314,377 | 4/1967 | Dehne | 104/172 S |
| 3,353,500 | 11/1967 | Orwin | 104/172 S |
| 3,407,751 | 10/1968 | Orwin | 104/172 BT |
| 3,424,112 | 1/1969 | Orwin | 104/172 |
| 3,434,431 | 3/1969 | Dehne | 104/172 S |
| 3,451,352 | 6/1969 | Curry | 104/172 |
| 3,518,946 | 7/1970 | Kavieff | 104/172 B |
| 3,726,233 | 4/1973 | Swartz | 104/96 |
| 3,830,165 | 8/1974 | Turner | 104/172 S |
| 3,874,304 | 4/1975 | Robert | 104/172 S |
| 3,995,561 | 12/1976 | Allor, Jr. | 104/172 S |
| 4,031,829 | 6/1977 | Bell et al. | 104/172 S |
| 4,203,369 | 5/1980 | Perrott | 104/96 |
| 4,223,610 | 9/1980 | Lempio | 104/96 |
| 4,464,997 | 8/1984 | Dehne | 104/172 S |

FOREIGN PATENT DOCUMENTS

| | | |
|---|---|---|
| 2361733 | 6/1975 | Fed. Rep. of Germany . |
| 2365206 | 7/1975 | Fed. Rep. of Germany . |
| 2523060 | 12/1976 | Fed. Rep. of Germany . |
| 1387874 | 12/1964 | France . |
| 2288659 | 5/1976 | France . |

*Primary Examiner*—Randolph A. Reese
*Assistant Examiner*—Dennis C. Rodgers
*Attorney, Agent, or Firm*—Joseph W. Farley

[57] ABSTRACT

Power and free conveyor systems wherein each article carrier includes a driving trolley having a movable driving member biased to an operable position in which it is engageable with a driven pusher to propel the carrier along a carrier track, the pusher being supported by a vertically spaced power track. Formed integrally with the driving member are: a holdback dog, a driving dog having a pair of wings projecting transversely to each side of the holdback dog, a stopping cam and an abutment, an accumulation cam, and an anti-jam cam, all cams being adapted to disengage the driving dog from a pusher. The stopping cam and abutment are engageable with a trackside stop member to stop the carrier; the accumulating cam is engageable with an actuator on the rear of a preceding carrier, also to stop the carrier; and the driving dog wings are engageable by forwarding and receiving pushers travelling on side-by-side power tracks at a transfer zone where the driving member and pushers are relatively positioned vertically so that improper overtaking and lateral engagement between them is prevented by the anti-jam cam and by beveled side surfaces on the driving dog wings and the pushers. At this relative positioning, the pushers are not engageable with the holdback dog but only with a portion of the driving dog that projects outwardly of the holdback dog toward the power track, thereby preventing interference between the holdback dog and any of the pushers.

33 Claims, 18 Drawing Figures

FIG. 10
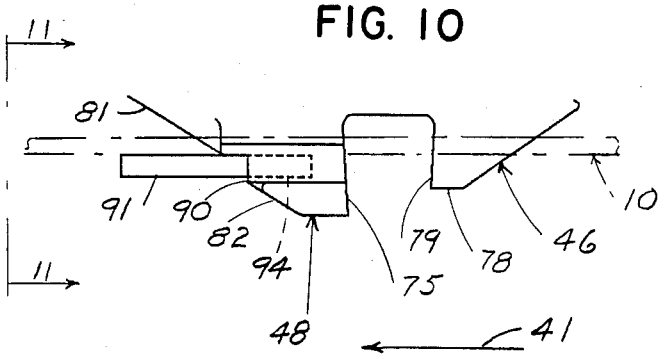
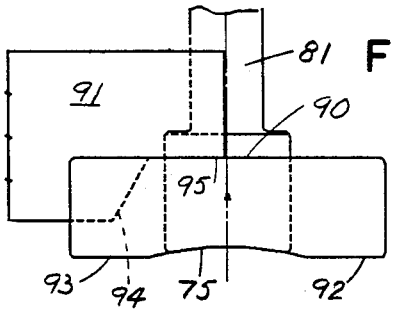
FIG. 12
FIG. 11
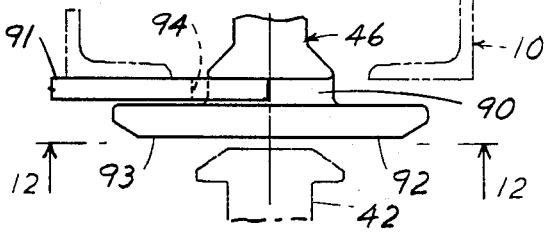

POWER AND FREE CONVEYOR SYSTEMS

This application is a continuation-in-part of application Ser. No. 272,381 filed June 10, 1981 abandoned May 10, 1984.

BACKGROUND OF THE INVENTION

This invention relates to improvements in conveyor systems of the power and free type.

Such conveyor systems conventionally include a carrier track, carriers each having a driving trolley supported on the carrier track, a power track spaced vertically from the carrier track, and carrier propelling means mounted on the power track, the propelling means being normally driven in a forward direction and including pusher members projecting toward the carrier track. The driving trolley has a driving member which is movable between operable and non-operable positions with respect to a pusher member and which is biased to the operable position.

Other conventional features of such conveyor systems include:

1. The capability of stopping and accumulating carriers by causing their driving members to be moved to nonoperable relation with the pushers; and 2. In more complex systems, the capability of providing transfer zones to which a carrier is propelled by a forwarding pusher and from which the carrier is to be propelled by a receiving pusher, the forwarding and receiving pushers usually (but not necessarily) being part of separately driven forwarding and receiving propelling means so that carrier speed, or relative spacing, or both, may be varied as desired throughout the system.

Reference is made to the following U.S. patents for a more complete disclosure of the features summarized above:

U.S. Pat. No. 3,044,416—The driving member of a carrier driving trolley is connected to a forwardly projecting lever which is engageable by a rearwardly projecting actuator on a preceding carrier to move the driving member to non-operable relation with a pusher member. Bumpers on the trolleys prevent damage to the lever which also serves as a counterweight to bias the driving member to the operable position relative to a pusher member.

U.S. Pat. No. 3,434,431—A stop member, positionable in the path of forward movement of a carrier driving trolley, contacts a cam surface on the driving member to move it out of engagement with a pusher member and is abutted by a holdback dog to stop the driving trolley. In this disclosure, a secondary stopping device is provided to insure that the desired abutting engagement of the stop member takes place.

U.S. Pat. Nos. 3,229,645 and 3,314,377—These patents relate to transfer zones through which carriers are propelled by forwarding and receiving pusher members. Each carrier is provided with a secondary driving member which is located rearwardly of a main driving member and is engageable by a forwarding pusher member to advance the carrier through the transfer zone. Interference between pusher and driving members is prevented by dimensional differences in the driving and holdback members of the carrier and in the spacing between the carrier track and the forwarding and receiving power tracks.

All of the results obtainable by the teachings of these prior patents are achieved in the conveyor systems of the present invention by a relatively less complex construction which offers several additional constructional and operational features including:

1. The capability of providing two types of conveyor systems, one having the power track located below the carrier track and the other having the power track located above the carrier track as in the prior patents mentioned above;

2. Transfer zones at which carriers can be accumulated and through which carriers can be propelled by forwarding and receiving pusher members without requiring a secondary driving member on each carrier and without interference between the carrier driving member and the forwarding and receiving pusher members;

3. Stops which positively arrest forward movement of a carrier; and

4. Carrier bumpers and accumulating mechanism which are located within a protected space partially enclosed by the structural members forming the carrier track.

SUMMARY OF THE INVENTION

In a conveyor system of the invention, having the conventional components described above in the second paragraph of this specification, the driving member of the driving trolley is formed with a driving dog and an actuating portion, the driving dog having a driving face engageable by a pusher member in the operable position of the driving member, and the actuating portion extending forwardly from the driving dog.

This actuating portion is provided with:

1. An accumulating cam surface adapted to engage a rearwardly extending actuator on a preceding carrier and move the driving member to non-operable position for carrier accumulation.

2. A stopping cam surface which is located between the accumulating cam surface and the driving face of the driving dog and which extends to an abutment surface formed on the actuating portion forwardly of the driving dog. A stop member, positionable in the path of movement of the driving member, is engageable by the stopping cam surface to move the driving member to non-operable position and is engageable by the abutment surface to stop the carrier; and 3. An anti-jam cam surface which is adapted to move the driving member toward non-operable position in response to engagement between the anti-jam cam surface and a pusher member overtaken thereby, thus preventing this type of interference between the driving and pusher members. In a first embodiment of the invention, the anti-jam cam surface is located outwardly of the abutment surface and extends toward the driving face of the driving dog. In a second embodiment, having a pivotally mounted driving member, the abutment surface acts as an antijam cam surface in the operable position of the driving member and as an abutment surface in the non-operable position of the driving member.

Preferably, a holdback dog is integrally formed with the driving member and has a holdback face engageable by a pusher member in the operable position of the driving member. Movement of the driving member to non-operable position under any of the accumulating, stopping or interference-preventing conditions described above also results in the holdback dog being non-engageable by a pusher member.

Preferably also, the driving dog of the driving member includes a pair of wing portions each projecting transversely to one side of the actuating portion, each provided with a continuation of the driving face of the driving dog, and each provided with a continuation of the anti-jam cam surface. The stop member is formed with an offset portion which is overlapped and is engageable by one of the wing portions to limit the movement of the driving member that results from the engagement of the stop member by the stopping cam surface and to thereby insure engagement between the stop member and the abutment on the actuating portion. Alternatively, excessive movement of the driving member resulting from engagement of the stop member by the stopping cam surface is prevented by motion limiting means provided on the body of the driving trolley.

In a conveyor system of the invention having a transfer zone to the entrance end of which a carrier is propelled by a forwarding pusher member whose path of travel is defined by a forwarding power track and from the exit end of which a carrier is to be propelled by a receiving pusher member whose path of travel is defined by a receiving power track, the invention 1. Provides parallel portions of the forwarding and receiving power tracks, which portions are located between the entrance and exit ends of the transfer zone, are offset to opposite sides of a vertical plane through the longitudinal centerline of the carrier track, and extend parallel to that plane. These parallel power track portions position the forwarding and receiving pusher members in transversely spaced relation so that a forwarding pusher member is engageable with one of the driving dog wing portions and a receiving pusher member is engageable with the other of the driving dog wing portions. At the exit end of the transfer zone one of the forwarding and receiving power tracks diverges from the other and the receiving power track converges into aligned relation with the centerline of the carrier track. A transfer takes place as the result of the successive engagement of the driving dog wing portions by forwarding and receiving pusher members.

2. Provides that the driving dog wing portions project to each side of the holdback face of a holdback dog, and that the parallel power track portions are so arranged relative to the vertical plane through the centerline of the carrier track as to prevent engagement of the holdback face by at least one, and preferably both, of the forwarding and receiving pusher members when positioned by the parallel power track portions. This eliminates the possibility of interference between the holdback dog and a pusher member in the transfer zone.

3. Provides beveled surfaces on the sides of the pusher members and on the sides of the driving dog wing portions, the aforementioned anti-jam cam surfaces on the driving dog wing portions, and means for relatively positioning the driving member and pusher members so that possible engagement therebetween is limited to engagement of the beveled and anti-jam cam surfaces, which engagement causes the driving member to be moved to a non-operable position. The relative positioning of the driving member and pusher members is accomplished by a cam bar mounted between the parallel track portions and engageable by the driving member, or alternatively by the relative elevation of the carrier track to a power track.

The foregoing and other features of the invention will be developed in the description to follow of the presently preferred embodiments disclosed in the accompanying drawings.

DESCRIPTION OF THE DRAWINGS

FIG. 10 is a fragmentary side elevation taken as indicated by the arrow 10 of FIG. 1 showing the relation between the driving trolley and a stop member;

FIG. 11 is a sectional elevation taken as indicated by the line 11—11 of FIG. 10;

FIG. 12 is a plan view taken as indicated by the line 12—12 of FIG. 11.

DESCRIPTION OF THE PREFERRED EMBODIMENTS

A. First Embodiment (FIGS. 1–13)

Figure 2:
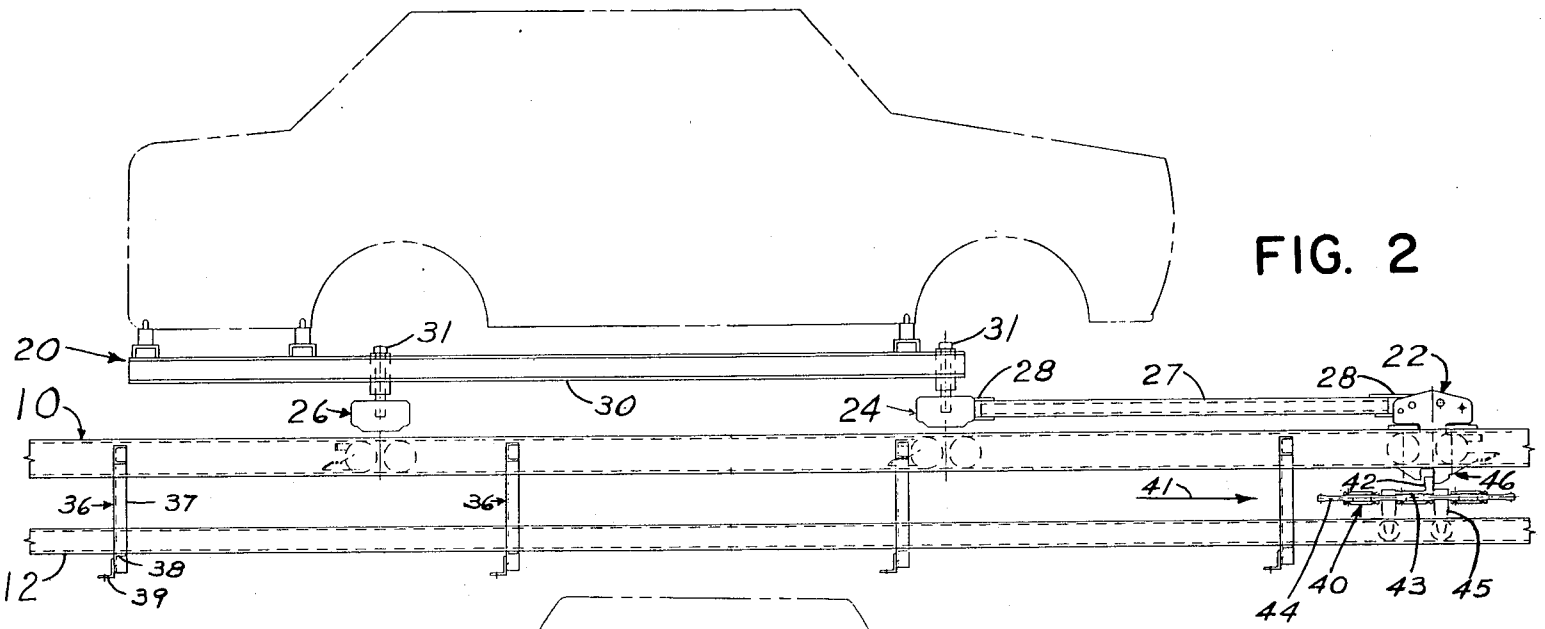
FIG. 2 is a side elevation of a load carrier of a conveyor system illustrating a first embodiment of the invention in which the power track is located below the carrier track.
Figure 3:
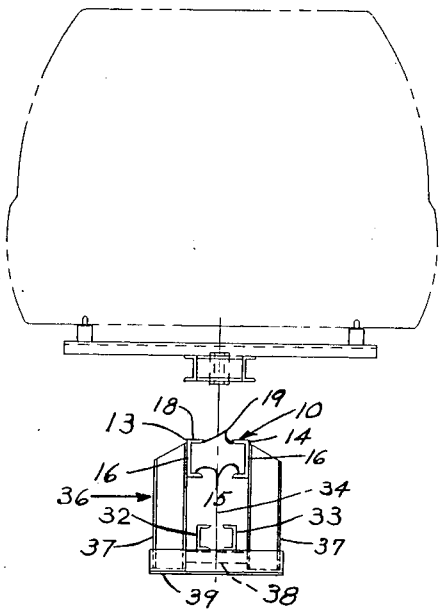
FIG. 3 is an end elevation of FIG. 2 showing the track structure.

FIGS. 2 and 3 illustrate a conveyor system of a first embodiment of the invention in which a carrier track 10 is located above a power track 12. The carrier track 10 is formed by a pair of channel-section track members 13 and 14 (FIG. 3), the lower flanges of which provide a pair of transversely spaced carrier supporting track surfaces 15 each projecting toward the other from one of the vertical web portions 16 extending perpendicular to the track surfaces. The upper flanges 18 of the track members 13 and 14 provide a pair of opposed guide surfaces 19.

A carrier 20 is supported on the carrier track 10 and will of course have a configuration suited for the article or articles being handled in a particular conveyor system. The representative form of carrier shown in FIG. 2 consists of a leading driving trolley 22, an intermediate load carrying trolley 24 and a trailing load carrying trolley 26. A tow bar 27 is connected to the driving trolley 22 and to the intermediate trolley 24 with universal type connections 28. Load carrying structure 30 is connected to each of the intermediate and trailing trolleys 24 and 26 by a vertical pivot pin 31.

Other possible carrier configurations include a carrier having a driving trolley 22 and a trailing trolley 26 with load supporting structure connected to either or both of these trolleys (see FIG. 14); and, a carrier having only a driving trolley 22 with load carrying structure connected thereto. Any carrier will include a driving trolley 22, regardless of what other carrier components may be employed.

The power track 12 is spaced vertically from the carrier track 10 and, as shown in FIG. 3 consists of a pair of channel-section track members 32 and 33 mounted in a transversely spaced toe-to-toe relation which is normally symmetrical to a vertical plane 34 extending through the longitudinal centerline of the carrier track 10. Structural frames 36 support the carrier and power tracks 10 and 12 at longitudinally spaced intervals as shown in FIG. 2. Each frame 36 consists of a pair of vertical channel section supports 37 for the carrier track members 13 and 14, a transverse angle section member 38 joined to the supports 37 and to the power track members 32 and 33, and a base member 39 which is secured to each of the other components of the frame 36 and may be mounted on any suitable foundation at any elevation desired.

Carrier propelling means 40 (FIG. 2) are mounted on the power track 12, are normally driven in a forward direction as indicated by the arrow 41, and include pusher members 42 projecting toward the carrier track 10. In the particular construction shown, the pusher members 42 are formed on links 43 of an endless chain 44 connected to power trolleys 45 which travel on the power track 12. Other forms of propelling means conventionally employed in the power and free conveyor systems can also be used.

Figure 4:
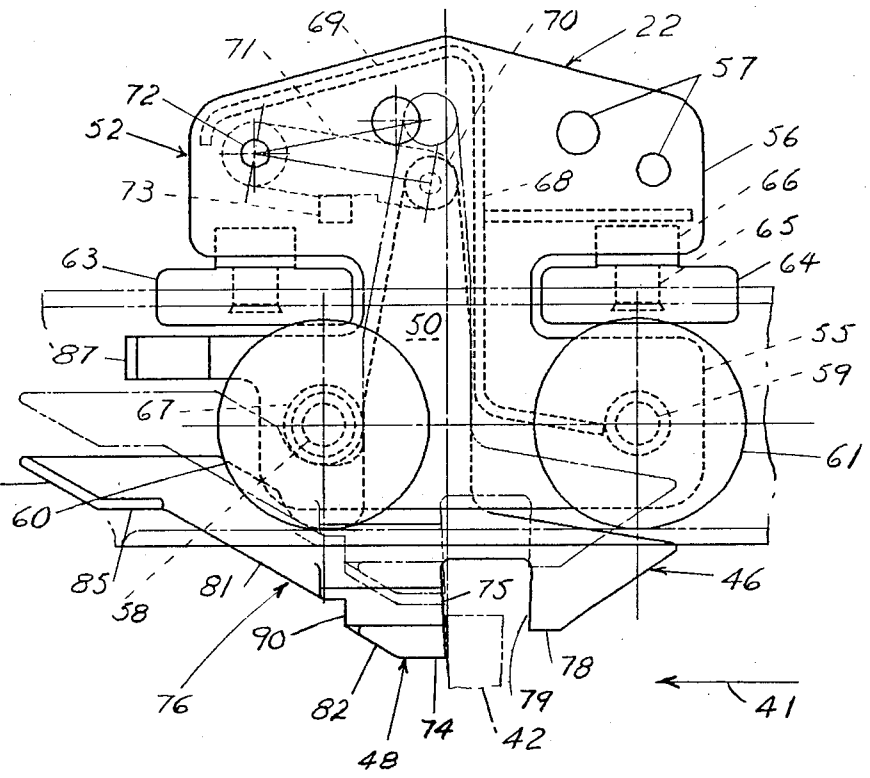
FIG. 4 is an enlarged side elevation of the driving trolley of the load carrier of FIG. 2.
Figure 5:
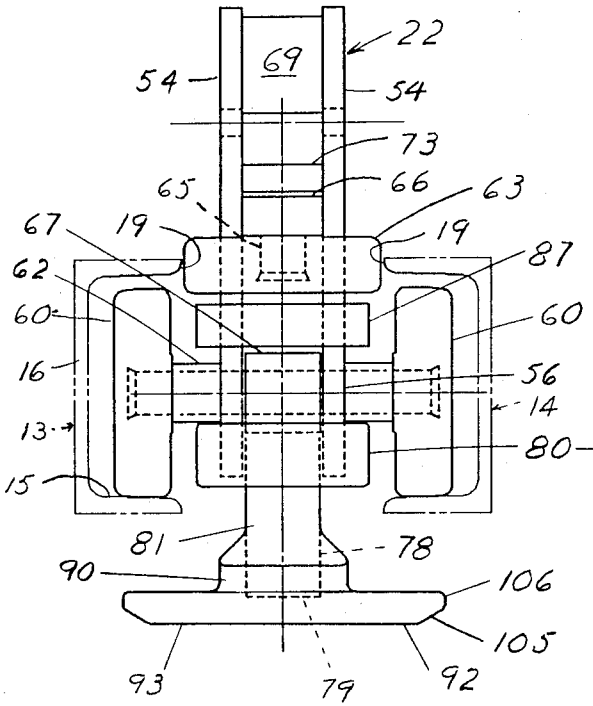
FIG. 5 is an end elevation of the trolley of FIG. 4.

Referring to FIGS. 2, 4 and 5, the driving trolley 22 has a driving member 46 movable between operable and non-operable positions with respect to a pusher member 42, and biased to the operable position shown in FIG. 2 and in solid line in FIG. 4. The driving member 46 includes an end 48, which extends from the driving trolley 22 toward the power track 12, and a stem 50 which is movably mounted within the driving trolley body 52 by suitable means to be described.

The trolley body 52 comprises a pair of transversely spaced, interconnected side plates 54 having wheel supporting portions 55 disposed within the carrier track 10 and carrying portions 56 disposed externally of the carrier track. Apertures 57 are provided in the portions 56 for connecting the tow bar 27 or load carrying structure to the trolley body. Front and rear axles 58 and 59 extend between the portions 55 with a pair of front and a pair of rear load carrying wheels 60 and 61 being mounted on the axles 58 and 59, respectively. Spacers 62 (FIG. 5) position the wheels 60 and 61 outwardly of the side plates 54. The tread dimension between each pair of wheels is considerably greater than normal practice for free trolleys of power and free conveyor systems, and requires a corresponding increase in the transverse spacing between the carrier track members 13 and 14. Front and rear guide rollers 63 and 64 are each mounted on a stub axle 65 secured to a block 66 interconnected between the carrying portions 56 of the side plates 54. Each of the guide rollers 63 and 64 is engageable with the guide surfaces 19 of the carrier track members and has a diameter corresponding to the increased spacing between these guide surfaces and corresponding substantially to the diameter of the wheels 60 and 61.

The dimensional increases in the transverse spacing between the carrier track members 13 and 14, the tread of the load carrying wheels 60 and 61, and the diameter of the guide rollers 63 and 64 result in improved lateral stability which is particularly advantageous in conveyor systems of the type shown in FIG. 2 having the platform-like article carrying structure 30 located above the carrier track 10. The lateral stability of the structure 30 may be maintained solely by the engagement between the trolleys 22 and 24 and the carrier track supporting surfaces 15 and guide surfaces 19. These dimensional increases, in the case of the driving trolley 22, also contribute to several other advantages resulting primarily from the construction of the driving member 46.

As shown in FIGS. 4 and 5, the stem 50 of the driving member 46 is movably mounted between the trolley body side plates 54 and between longitudinally spaced guides consisting of a roller bushing 67 on the front axle 58 and a guide portion 68 of a web 69 which interconnects the side plates 54. The inner end 70 of the stem is connected to an arm 71 carried by a pivot pin 72 mounted between the side plates. The driving member 46 of the trolley of FIGS. 4 and 5 is biased to the operable position by its weight, and the arm 71 serves primarily to define this position by engaging an abutment 73 on the trolley body.

The end 48 of the driving member 46 is integrally formed with a driving dog 74 and an actuating portion 76, the driving dog 74 having a driving face 75 engageable by a pusher 42 in the operable position of the driving member and the actuating portion 76 extending from the driving dog in the forward direction 41. A holdback dog 78 is also integrally formed with the driving member 46 in the construction shown and has a holdback face 79 engageable by a pusher 42 in the operable position of the driving member; however, the holdback face projects outwardly less than the driving face 75 and is of limited width, as shown in FIG. 5. Provided on the actuating portion 76 are an accumulating cam surface 80, a stopping cam surface 81, and an anti-jam cam surface 82.

Figure 6:
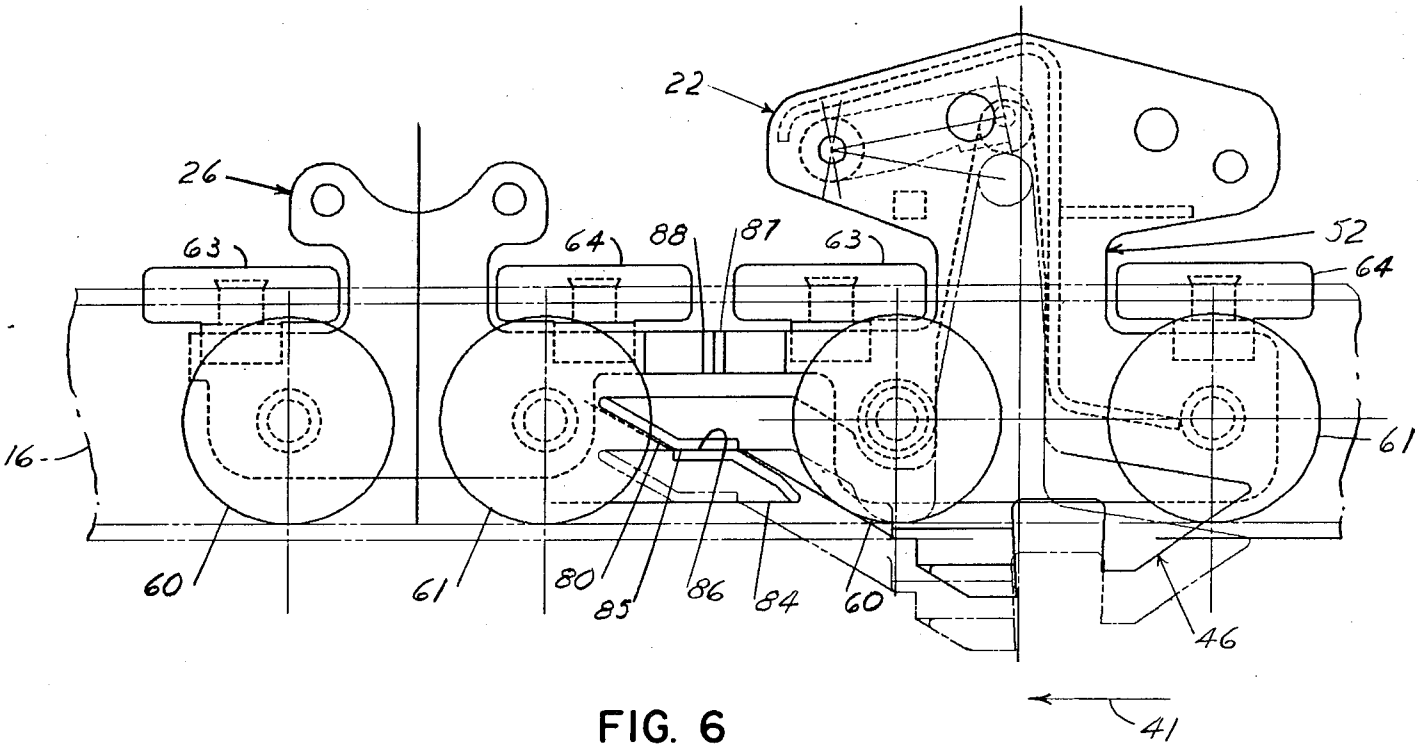
FIG. 6 is a side elevation showing an accumulated relation between a trailing trolley of one carrier and a driving trolley of a following carrier.

The accumulating cam surface 80 is located adjacent to the forward end of the actuating portion 76 and is positioned between the web portions 16 of the carrier track members 13 and 14. As shown in FIGS. 2 and 6, each carrier is provided with a rearwardly extending actuator 84 positioned between the web portions 16 and adapted to be engaged by the accumulating cam surface 80 of a following carrier for moving the driving member 46 of the following carrier to the non-operable position shown in full line in FIG. 6. Complementary retaining surface 85 on the actuating portion 76 and 86 on the actuator 84 maintain the driving member 46 in this position.

Each carrier is also provided with a forwardly projecting bumper 87 and a rearwardly projecting bumper 88 positioned between the web portions 16 of the carrier track members 13 and 14. As illustrated in FIG. 6, the rearwardly projecting bumper 88 of one carrier is engageable by the forwardly projecting bumper 87 of a following carrier when the driving member 46 of the following carrier has been moved to the non-operable position in response to the engagement of the actuator 84 of the one carrier by the accumulating cam surface 80 of the following carrier. The retaining surfaces 85 and 86 are so arranged that the driving member is in non-operable position prior to engagement of the bumpers 87 and 88.

FIGS. 2 and 6 illustrate the manner in which the actuator 84 and the bumpers 87 and 88 are installed on the multipletrolley carrier 20. The forward bumper 87 is mounted on the body 52 of the driving trolley 22; while the actuator 84 and rearward bumper 88 are mounted on the body of the trailing trolley 26 (and optionally also on the body of the intermediate trolley 24, as shown in FIG. 2, if a maximum density accumulation zone is desired). In a conveyor system having carriers each including only a single driving trolley, an actuator 84 and a rearward bumper 88 would be mounted on the body of each such driving trolley.

The stopping cam surface 81 of the actuating portion 76 is located between the accumulating cam surface 80 and the driving face 75 of the driving dog and extends to an abutment surface 90 formed on the actuating portion 76 forwardly of the driving face 75 of the driving dog. In the operable position of the driving member shown in FIG. 4, the stopping cam surface 81 is located externally of the carrier track 10 and functions in the manner shown in FIGS. 10–12. A stop member 91 (movable transversely of the carrier track 10 in the known manner) is positionable in the path of movement of the driving member 46, is engageable by the stopping cam surface 81 to move the driving member to non-operable position as shown in FIG. 11, and is engageable by the abutment surface 90 as shown in FIGS. 10 and 12 to stop the carrier. When the holdback dog 78 is integrally formed with the driving member 46, that dog also becomes non-engageable by a pusher member 42 when the driving member 46 is moved to non-operable position by the stop member 91. The abutment surface 90 projects to each side of the holdback face 79 to prevent interference of the holdback face with the stop member 91 when it is disengaged.

The anti-jam cam surface 82 of the actuating portion 76 is located outwardly of the abutment surface 90 and extends toward the driving face 75 of the driving dog. This anti-jam cam surface 82 is adapted to move the driving member 46 toward non-operable position in response to engagement between the anti-jam cam surface 82 and a pusher member 42 overtaken thereby, which engagement may occur, for example, at a transfer zone.

The driving dog 74 of the driving member 46 is preferably provided with a pair of integral transversely extending wing portions 92 and 93. Each of these wing portions project to one side of the driving member and project from the actuating portion 76 rearwardly and outwardly of the abutment surface 90. Each wing portion 92 and 93 is provided with a continuation of the driving face 75 and with a continuation of the anti-jam cam surface 82. Each wing portion 92 and 93 also projects to one side of the holdback dog 78. These wing portions coact with stop members 91 and with pushers 42 at a transfer zone.

Referring again to FIGS. 10–12, the stop member 91 is formed with an offset portion 94 which extends forwardly and to one side of the stopping surface 95 of the stop member. The forward extent of the offset portion 94 is such that as the driving member 46 is moved to non-operable position in response to engagement of the stop member 91 by the stopping cam surface 81, the offset portion 94 is overlapped and is engageable by one of the wing portions 93 of the driving dog 74. Movement of the driving member 46 is thereby limited and engagement of the stopping surface 95 of the stop member 91 by the abutment surface 90 of the driving member 46 is insured.

Figure 1:
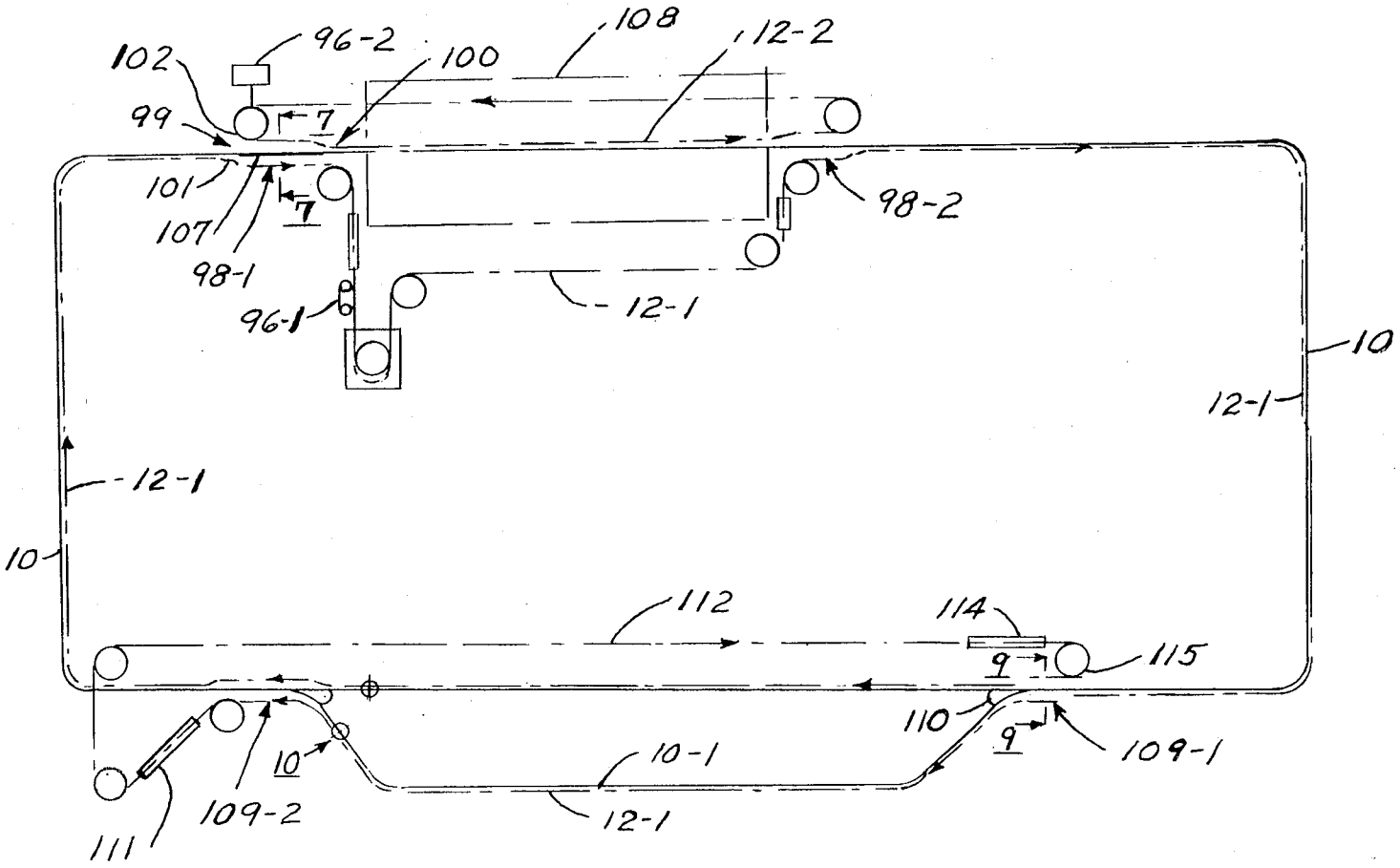
FIG. 1 is a schematic plan view of a representative conveyor system illustrating features of the invention.

The coaction between the wing portions 92 and 93 of the driving member 46 and pushers 42 will be described in connection with the conveyor system schematically shown in FIG. 1. In this system, which is not intended to represent any particular system but to merely illustrate the manner in which the present invention is used, the path of the carrier track 10 appears as a solid line. A carrier travelling around the system in a clockwise direction and located on the vertical line at the left hand side of FIG. 1, is propelled by a pusher member 42-1 of a chain driven by a drive unit 96-1 and travelling in a path defined by a power track 12-1 represented in broken line. The relation between the carrier track 10 and the power track 12-1 along this portion of the system is the normal one shown in FIGS. 2–5, the pusher and driving members being symmetrical to the vertical plane 34 through the longitudinal centerline of the carrier track 10 and the pusher member being engageable with the driving and holdback faces 75 and 79 of the driving and holdback dogs 74 and 78 of the driving member 46.

Figure 7:
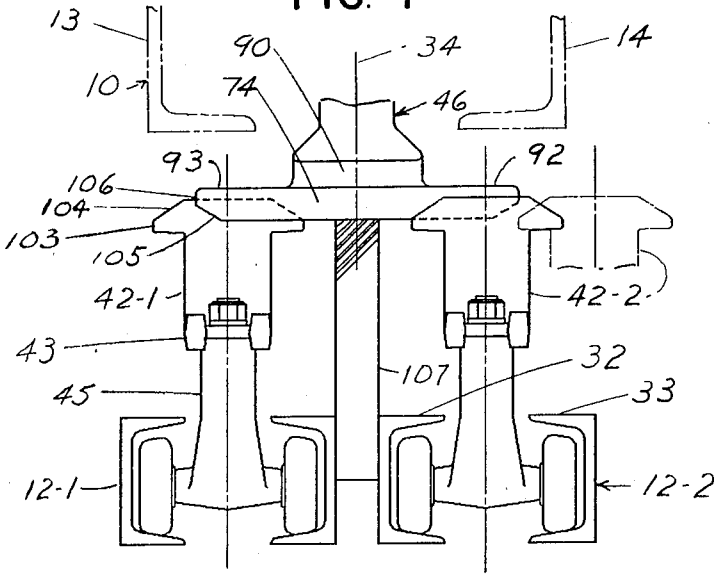
FIG. 7 is a fragmentary sectional elevation taken as indicated by the line 7—7 of FIG. 1 showing the relation between the driving trolley and forwarding and receiving pushers at one type of transfer.

As the carrier proceeds to the right on the upper horizontal track line of FIG. 1, it enters a transfer zone 98-1 to which it is propelled by a pusher member 42-1 (acting as a forwarding pusher member) and from which it is to be propelled by a pusher member 42-2 (acting as a receiving pusher member) of another chain independently driven by a drive unit 96-2 and travelling in a path defined by a power track 12-2. The transfer zone 98-1 has an entrance end 99, and an exit end 100. At the entrance end 99 there is an offset 101 in the forwarding power track 12-1 to one side of the vertical plane 34, and a convergence 102 of the receiving power track 12-2 relative to the vertical plane 34. Between the entrance end 99 and the exit end 100, the forwarding and receiving power tracks 12-1 and 12-2 have parallel portions which, as shown in FIG. 7, are offset to opposite sides of the vertical plane 34, extend parallel thereto, and preferably are arranged in substantially symmetrical relation therewith. These parallel power track portions position the forwarding and receiving pusher members 42-1 and 42-2 in a transversely spaced relation at which a forwarding pusher member 42-1 is engageable with one of the driving dog wing portions 93 and a receiving pusher member is engageable with the other of the driving dog wing portions 92. At the exit end 100, the forwarding power track 12-1 diverges from the receiving power track 12-2 which converges into the normal vertically aligned relation with the carrier track 10.

Interference and jamming conditions between the driving member 46 of a carrier and the forwarding and receiving pusher members 42-1 and 42-2 are positively prevented by the following features:

1. The wing portions 92 and 93 of the driving dog 74 project to each side of the holdback face 79 of the holdback dog and the forwarding and receiving pushers 42-1 and 42-2 are non-engageable with the holdback face 79 when positioned in transversely spaced relation by the parallel forwarding and receiving track portions.

2. The side faces 103 of the pusher members 42-1 and 42-2 are each formed with a beveled surface 104 (FIG. 7), and a complementary beveled surface 105 is formed on the side face 106 of each wing portion 92 and 93 of the driving dog. Lateral interference, which could take place between the driving dog 74 and a receiving pusher 42-2 at the convergence 102 of the receiving track relative to the vertical plane 34, is prevented by the engagement of the beveled surfaces 104 and 105 which are adapted to move the driving member to non-operable position. Positioning means relatively locates the driving dog and receiving pusher member vertically so that any lateral engagement between them is limited to the beveled surfaces 104 and 105. This positioning means, in the transfer zone construction of FIGS. 7 and 8, comprises a cam bar 107 which is supported symmetrically to the vertical plane 34 by the power tracks 12-1 and 12-2, extends from the entrance end 99 to the exit end 100 of the transfer zone, is engageable by the driving dog 74, and moves the driving member 46 from the full line to the broken line position shown in FIG. 8.

3. The cam bar 107 also limits any overtaking engagement between the driving member and the forwarding and receiving pusher members 42-1 and 42-2 to the anti-jam cam surface 82.

As a result of the foregoing features the drive units 96-1 and 96-2 do not require any synchronization or interlock controls and can be operated at any desired speed differential. Should the driving member of a carrier, being propelled in the transfer zone 98-1 by a pusher member on either the forwarding power track 12-1 or the receiving power track 12-2, engage a slower moving pusher member on the other power track, the driving member 46 will simply disengage and will be re-engaged by the next pusher member until the carrier clears the exit end 100. Should the driving member engage a stopped receiving pusher member, the same disengagement of the driving member 46 will occur but the carrier will not clear the transfer zone until the receiving pusher members are again moving. Any following carriers will accumulate behind the stopped carrier. If desired, the transfer zone can be made a part of the system where carriers are accumulated by providing a stop member 91 at the exit side of, or even in the transfer zone 98-1.

Referring again to FIG. 1, from the transfer zone 98-1 a carrier proceeds through a processing station 108 and to a second transfer zone 98-2. This zone is the same as the zone 98-1 except that a pusher member 42-2 acts as the forwarding pusher member and a pusher member 42-1 acts as the receiving one. The carrier is then advanced to a transfer zone 109-1 where a branch carrier track 10-1 connects with the main carrier track 10 through a switch 110. The power track 12-1 follows the branch carrier track 10-1 to a re-entry transfer zone 109-2, passes through a change in elevation at 111 and returns to the transfer zone 109-1 along the path 112 and elevation change 114. The transfer zones 109-1 and 109-2 illustrate an arrangement frequently employed in power and free conveyor systems where all the pusher members involved in a transfer are on the same chain, with one pusher member 42-1 acting as a forwarding pusher member and another pusher member 42-1 acting as a receiving pusher member.

Figure 9:
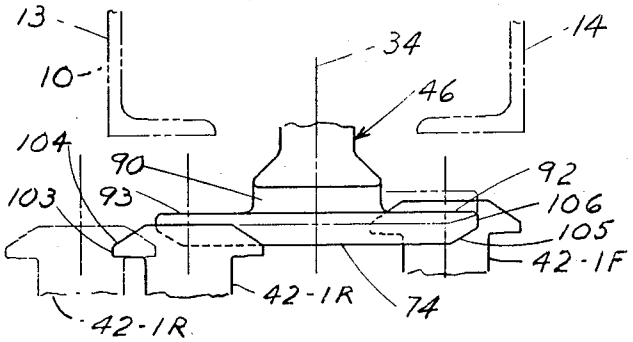
FIG. 9 is a fragmentary sectional elevation taken as indicated by the line 9—9 of FIG. 1 showing the relation between the driving trolley and forwarding and receiving pushers at another type of transfer.

FIG. 9 schematically illustrates an alternative positioning means to the cam bar 107 for relatively locating the driving dog and pusher members vertically at the transfer zone 109-1 where a pusher member 42-1F is forwarding and a pusher member 42-1R is receiving. Since these pusher members are on the same chain and are moving at the same speed, the only possible interference is the lateral interference that may occur at the convergence 115 of the receiving pusher at the entrance end of the transfer zone. Positioning is accomplished by arranging the structure supporting the power track of the receiving pusher 42-1R at an elevation relative to the carrier track 10 such that lateral engagement between the driving dog wing portion 93 and a receiving pusher member 42-1R is limited to the engagement of the beveled surfaces 104 and 105, at least in the region of the convergence 115. If such engagement should occur, the driving member 46 will be moved toward the non-operative position a distance sufficient to clear the receiving pusher 42-1R but not sufficient for the driving dog wing portion 92 to disengage from the forwarding pusher member 42-1F.

The arrangement of FIG. 9 can be used at the re-entry transfer zone 109-2 except that here the convergence is in, and the positioning means would be employed for, the power track 12-1, which does not support the receiving pusher members.

Figure 8:
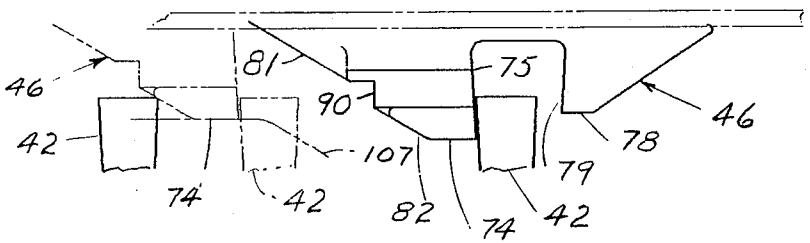
FIG. 8 is a fragmentary side elevation further illustrating various relationships between the driving trolley and pushers in the transfer of FIG. 7.

Both of the forwarding and receiving power tracks may be supported to position their respective pusher members at the vertical elevation of the pusher member 42-1R of FIG. 9 for the same results obtainable with the cam bar 107 of FIGS. 7 and 8.

Another preferred feature shown in FIGS. 7 and 9 is that the wing portions 92 and 93 are disposed within an operational area bounded by vertical planes through the transverse extremities of the carrier track members 13 and 14, and that the employment of parallel track members 32 and 33 for the power tracks enables the forwarding and receiving pusher members to be disposed within this area, thereby simplifying the track supporting structure.

Figure 13:
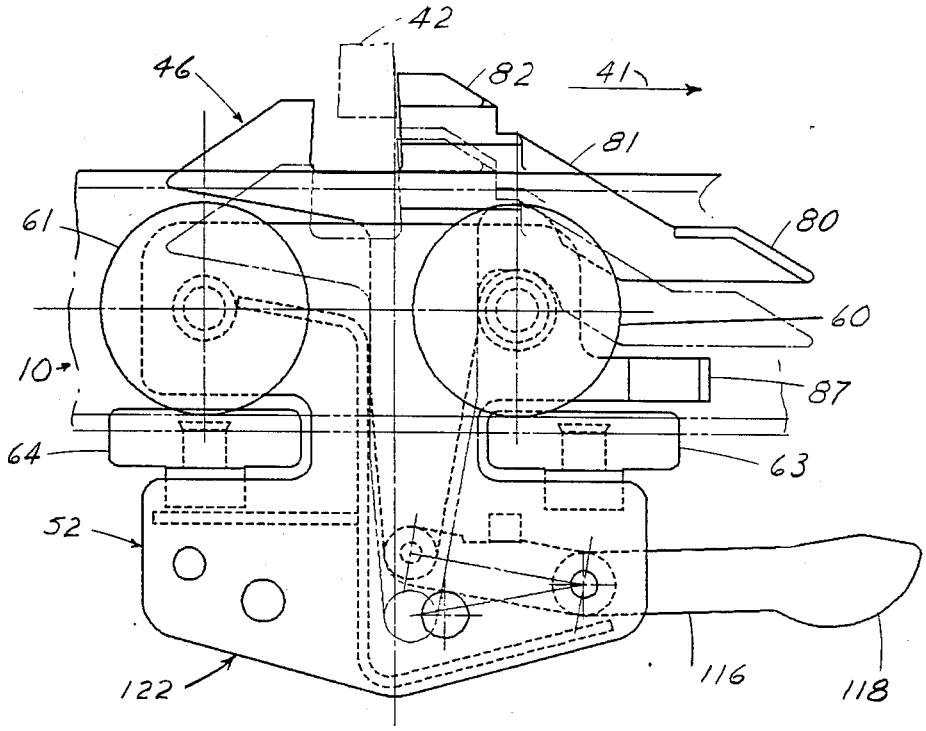
FIG. 13 is a side elevation of a driving trolley of the invention modified for use in a conveyor system of the invention in which the carrier track is located below the power track.

FIG. 13 illustrates a carrier driving trolley 122 of the invention for an overhead power and free conveyor system having the power track mounted above the carrier track 10. The trolley 122 is essentially the same as the driving trolley 22 except that a lever 116 is employed in place of the arm 71 and is provided with a counterweight portion 118 adapted to bias the driving member 46 to the operative position shown relative to a pusher member 42.

B. Second Embodiment (FIGS. 14–18)

In describing the second embodiment, which incorporates all of the features of the first embodiment, parts corresponding to those of the first embodiment will be identified by the same reference numerals and the letter "A" or increased by 100.

Figure 14:
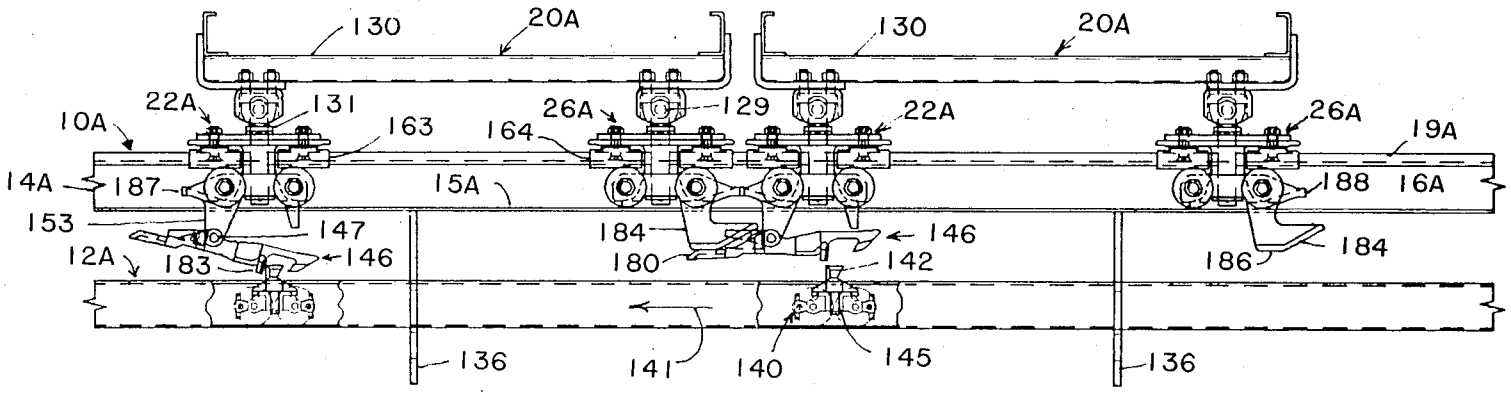
FIG. 14 is a side elevation similar to FIG. 2 showing load carriers of a second embodiment of the invention in accumulated relation.
Figure 15:
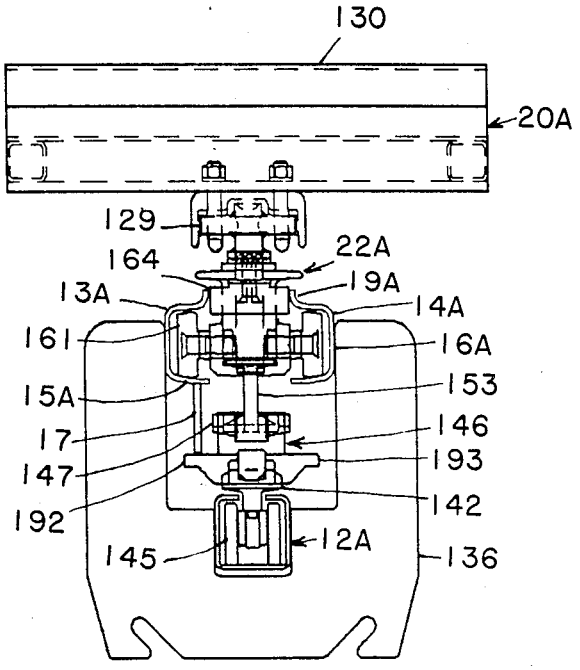
FIG. 15 is a transverse elevation of the track structure and load carrier of FIG. 14, including an optional hold down bar for the driving member of the driving trolley.

FIGS. 14 and 15 illustrate a conveyor system generally similar to that shown in FIGS. 2 and 3. A carrier track 10A, formed by a pair of channel-section track members 13A and 14A having lower supporting track surfaces 15A and upper guide track surfaces 19A is spaced vertically above a power track 12A. The tracks are secured to longitudinally spaced structural frames or yokes 136.

Carriers 20A are supported on the carrier track 10A. Each carrier 20A consists of a leading driving trolley 22A, a trailing trolley 26A, and load carrying structure 130 connected to each of these trolleys by a fitting which includes a vertical pivot pin 131 rotatably engaging the trolley body and a horizontal pivot 129 on which the load carrying structure articulates.

Carrier propelling means 140 are mounted on the power track 12A, are normally driven in the forward direction indicated by the arrow 141, and consist of pusher members 142 projecting toward the carrier track 10A, the pusher members 142 being provided on power trolleys 145 which travel on the power track 12A. Each power trolley 145 forms a link of an endless chain (not shown) of the type illustrated in U.S. Pat. No. 3,559,585 having supporting and guiding rollers on alternative links.

As shown in FIGS. 14–17, each driving trolley 22A has a body 152 of which are mounted pairs of front and rear load carrying wheels 160 and 161 and front and rear guide rollers 163 and 164. Depending from the forward portion of the trolley body 152 is a strut 153 to which a driving member 146 is connected by a pivot pin 147 for movement between operable and non-operable positions on a pivotal axis extending transversely of the carrier track 10A and substantially parallel to the axes of the load carrying wheels 160 and 161. The operable position of the driving member 146 is shown at the left-hand portion of FIG. 14; the nonoperable portion appears at the central portion of FIG. 14 and in FIG. 16.

The driving member 146 is integrally formed with a driving dog 174, having a driving face 175, and with an actuating portion 176 which extends forwardly from the driving dog 174 and which includes a first arm 176-1 extending rearwardly from the axis of the pivot pin 147 and a second arm 176-2 extending forwardly from that axis. The driving member is biased to operable position by the first arm 176-1. An accumulating cam surface 180 is provided on the second arm 176-2 adjacent to the forward end thereof. Provided on the first arm 176-1, in addition to the driving dog 174 and a holdback dog 178, are a stopping cam surface 181 and a surface 183 which performs the combined functions of the anti-jam cam surface 82 and the abutment surface 90 of the first embodiment.

As shown in FIG. 14, the trailing trolley 26A of each carrier 20A is provided with a rearwardly extending actuator 184 adapted to be engaged by the accumulating cam surface 180 of a following carrier for moving the driving member 146 of the following carrier to the non-operable position. Complimentary retaining surfaces 185 on the second arm 176-2 and 186 on the actuator 184 maintain the driving member 146 in this position. Forwardly and rearwardly projecting bumpers 187 and 188 provided respectively on the leading trolley 22A and trailing trolley 26A of each carrier 20A are positioned between the web portions 16A of the carrier track members 13A and 14A; and, the rearward bumper 188 of one carrier is engageable by the forward bumper 187 of a following carrier when the driving member 146 of the following carrier has been moved to the non-operable position in response to the engagement of the actuator 184 of the one carrier by the accumulating cam surface 180 of the following carrier.

Figure 17:
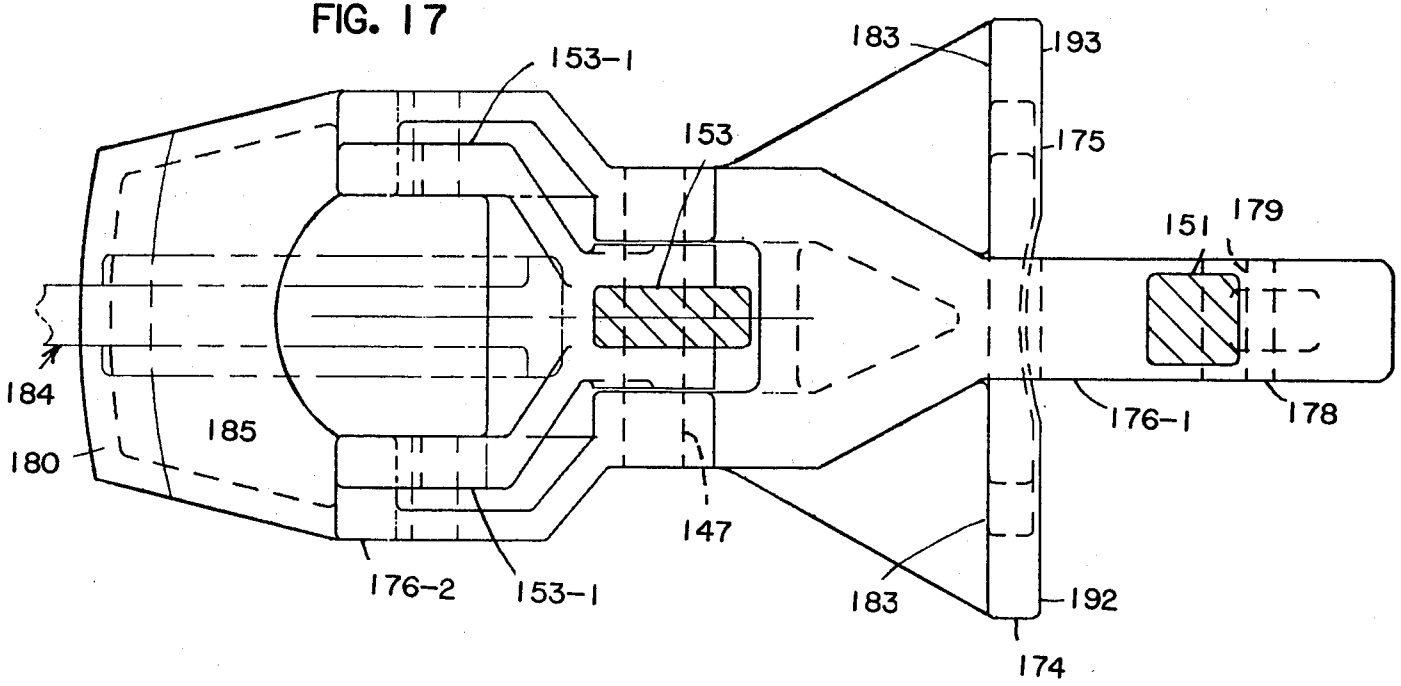
FIG. 17 is a plan view taken as indicated by the line 17—17 of FIG. 16 and including a phantom showing of an actuator on the rear trolley of a preceding carrier.

The bumpers also prevent contact between the actuator 184 and the body 152 of the driving trolley 22A due to the relative configurations of the actuator 184, the trolley body 152 and the driving member 146, as shown in FIGS. 14 and 17. The actuator 184 is relatively narrow in the direction transverse to the carrier track 10A, and extends between and above a bifurcated portion 153-1 formed with the strut 153 of the trolley body 152, which portion is engageable by the second arm 176-2 of the driving member for limiting movement of the driving member to its operable position. The second arm 176-2 of the driving member, as shown by the plan view, FIG. 17, extends forwardly from the pivot pin 147 in the form of bifurcated arms whose forward ends are connected to provide relatively wide transversely extending accumulating cam and retaining surfaces 180 and 185.

Figure 16:
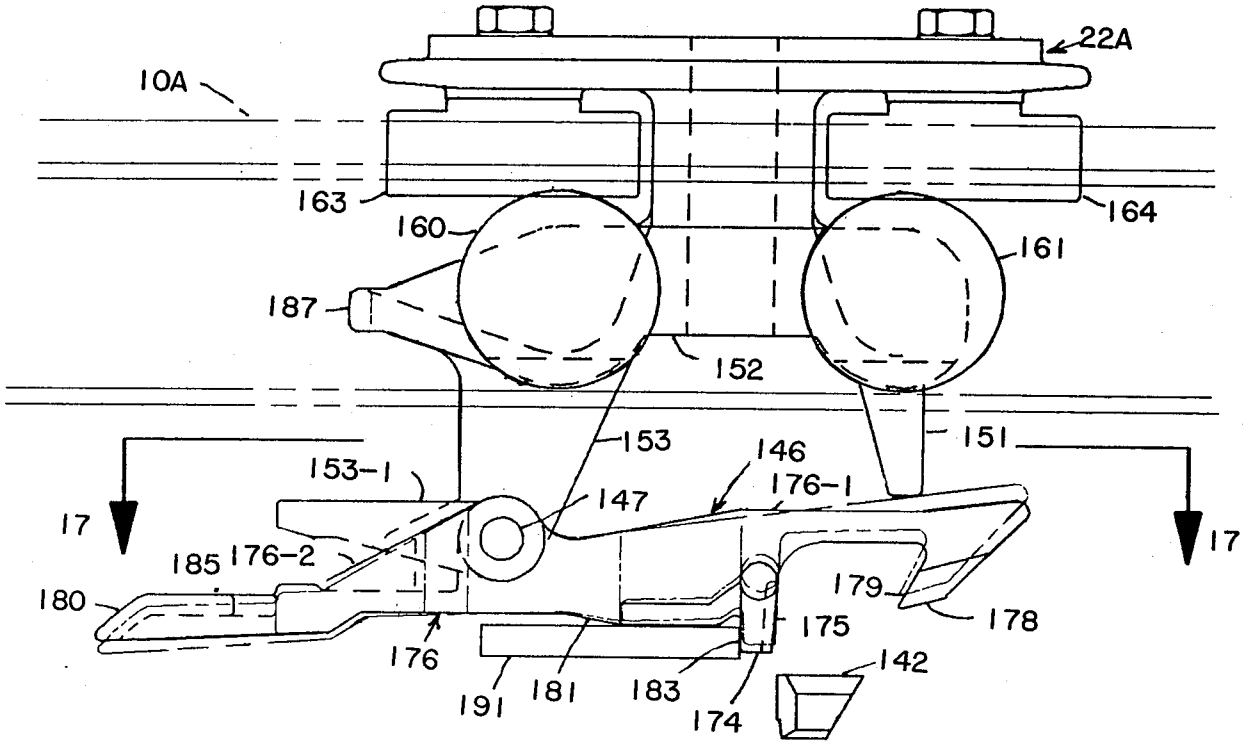
FIG. 16 is an enlarged side elevation of the driving trolley of the load carrier of FIG. 14 showing the relation between the trolley driving member and a stop member.

The stopping cam surface 181, located between the accumulating cam surface 180 and the driving face 175 of the driving dog, extends to the dual-functioning surface 183. When the driving member is in its operable position and a stop member 191 is positioned in its path of movement, the stop member 191 is engageable by the stopping cam surface 181 to move the driving member 146 to non-operable position as shown in FIG. 16, and is engageable by the surface 183 acting as an abutment surface to stop the carrier. Motion limiting means in the form of a projection 151 provided on the trolley body 152 is engageable by the first arm 176-1 of the driving member to limit its movement to non-operable position and insure abutting engagement between the surface 183 and the stop member 191.

The driving dog 174 of the driving member 146 is provided with a pair of integral transversely extending wing portions 192 and 193. Each of these wing portions projects to one side of the holdback dog 178 and is provided with a continuation of the driving face 175 and with a continuation of the surface 183. These wing portions coact with the pushers 142 at a transfer zone in the manner previously described in connection with the first embodiment.

When the driving member 146 is in its normal operative position defined by engagement between the second arm 176-2 of the driving member and the portion 153-1 of the trolley body 152 (as shown by the driving member at the left side of FIG. 14), the surface 183 is positioned relative to the axis of the pivot pin 147 in such a manner as to be adapted to move the driving member 146 toward non-operable position in response to engagement between the surface 183 and a pusher member 142 overtaken thereby. The rearwardly facing surface of the pusher member is adapted to be positively engaged by the face 179 of the holdback dog 178, but not by the surface 183 acting as an anti-jam cam.

Figure 18:
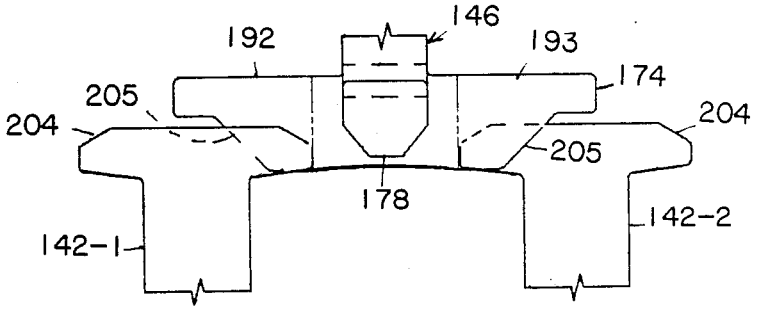
FIG. 18 is a fragmentary transverse elevation similar to FIG. 7 showing the relation between the driving member of the second embodiment and a pair of pusher members arranged in sideby-side relation.

As further illustrated by FIG. 18, interference and jamming between the driving member 146 of a carrier 20A dna a pair of pusher members 142-1 and 142-2 travelling on a pair of parallel power tracks (as in FIG. 7) are positively prevented in same manner as the first embodiment. The pusher members 142-1 and 142-2 engage the wing portions 192 and 193 of the driving dog 174 and are non-engageable with the holdback dog 178 so that jamming engagement between the holdback dog and a slower moving or stopped pusher is not possible.

Lateral interference is prevented by the provision of beveled side surfaces 204 on the pusher members 142-1 and 142-2 and by the provision of complimentary beveled side surfaces 205 on each wing portion 192 and 193 of the driving dog 174. Positioning means such as the cam bar 107 previously described can be employed to ensure that any possible lateral engagement between the driving member 146 and the pusher members 142-1 or 142-2 is limited to the engagement of their beveled surfaces 204 and 205.

Another feature of the wing portions 192 and 193 (or the wing portions 92 and 93 of the first embodiment) is illustrated in FIG. 15. A hold down means in the form of a bar 17 is supported by one of the carrier track members 13A of the track structure and is engageable by one of the wing portions 192 for preventing movement of the driving member 146 from its operable to its non-operable position. The hold down bar 17 can be employed throughout inclined or declined track portions of a conveyor system for preventing disengagement of a driving member from a pusher along such track portions.

What is claimed is:

1. In a conveyor system having a carrier track; carriers each including a driving trolley supported on the carrier track; forwarding and receiving power conveyors each comprising a power track spaced vertically from the carrier track, carrier propelling means mounted on the power track and including pusher members projecting toward the carrier track, an endless chain connected to the pusher members, and a drive unit for the endless chain; the driving trolley having a driving member movable between operable and non-operable positions with respect to the pusher members and biased to the operable position; and a transfer zone to which a carrier is propelled by a pusher member of the forwarding power conveyor and from which a carrier is propelled by a pusher member of the receiving power conveyor; the improvement wherein:

the driving member is formed with a driving dog having a driving face normally engageable by a pusher member in the operable position of the driving member;

the driving dog is provided with a pair of transversely extending wing portions each projecting to one side of the driving member and each having a continuation of the driving face;

a holdback dog is provided on the driving trolley, said holdback dog having a holdback face normally engageable by a pusher member, said wing portions of the driving dog project to each side of said holdback face, and said driving face of the driving dog includes a portion which projects toward the power track a distance greater than said holdback face;

the transfer zone has an entrance end, an exit end and includes a forwarding power track defining the path of travel of a forwarding pusher member and a receiving power track defining the path of travel of a receiving pusher member;

said forwarding and receiving power tracks between said entrance and exit ends have portions positioning the forwarding and receiving pusher members in a transversely spaced relation in which a forwarding pusher member is engageable with one portion of said driving face and a receiving pusher member is engageable with another portion of said driving face;

said driving dog including said wing portions thereof is provided with an anti-jam cam surface located forwardly of said driving face and adapted to move said driving member toward said non-operable position in response to overtaking engagement between said anti-jam cam surface and one of the forwarding and receiving pusher members; and positioning means is provided in said transfer zone for relatively positioning said driving dog and said forwarding and receiving pusher members vertically such that overtaking and driving engagement between said driving dog and said forwarding and receiving pusher members is limited to said anti-jam cam surface for overtaking engagement and is limited to said outwardly projecting portion of said driving face for driving engagement whereby the drive unit of said forwarding power conveyor and the drive unit of said receiving power conveyor are independently and non-synchronously operable.

2. A conveyor system according to claim 1 wherein each carrier includes a rearwardly projecting actuator and said driving member of each driving trolley is operably associated with accumulation means for disengaging said driving dog from a pusher member in response to contact between the accumulation means and the actuator of a preceding carrier, said accumulation means being operable to move said driving member to non-operable position with respect to both forwarding and receiving pusher members at a transfer zone.

3. A conveyor system according to claim 2 wherein an actuating portion is integrally formed with the driving member, and said accumulation means comprises an accumulating cam surface formed on said actuating portion forwardly of the driving dog and engageable with said actuator.

4. A conveyor system according to claim 3 wherein the carrier track includes a pair of vertical web portions transversely spaced to either side of the driving trolley, and each carrier is provided with forwardly and rearwardly projecting bumpers positioned between said web portions of the carrier track.

5. A conveyor system according to claim 4 wherein said accumulating cam surface and said actuator are positioned between said web portions of the carrier track.

6. A conveyor system according to claim 3 wherein said actuating portion is provided with a stopping cam surface and an abutment, said stopping cam surface being located rearwardly of said accumulating cam surface and said abutment being located between said stopping cam surface and said driving dog; and a stop member, positionable in the path of movement of said stopping cam surface, is engageable thereby to move the driving member to non-operable position and is engageable by the abutment to stop the carrier.

7. A conveyor system according to claim 3 wherein said driving member is connected to the driving trolley for movement between said operable and non-operable position on a pivotal axis extending transversely of the carrier track, and said actuating portion includes a first arm extending rearwardly from said pivotal axis and a second arm extending forwardly from said pivotal axis, said accumulating cam surface being formed on said second arm adjacent to the forward end thereof, and said driving dog being formed on said first arm.

8. A conveyor system according to claim 7 wherein said first arm is provided with said anti-jam cam surface and with a stopping cam surface located between said pivotal axis and said anti-jam cam surface; and a stop member, positionable in the path of movement of said stopping cam surface, is engageable thereby to move the driving member to a non-operable position in which the stop member is abuttingly engageable by said anti-jam cam surface to stop the carrier.

9. A conveyor system according to claim 1 wherein said holdback dog is provided on said driving member.

10. A conveyor system according to claim 1 wherein said holdback dog is integrally formed with said driving member.

11. A conveyor system according to claim 1, 9 or 10 wherein said positioning means comprises a cam bar engageable by said driving member, said cam bar being adapted to move said driving member toward said non-operable position.

12. A conveyor system according to claim 11 wherein said cam bar extends substantially the length of said transfer zone.

13. A conveyor system according to claim 11 wherein said forwarding and receiving power track portions which position the forwarding and receiving pusher members in said transversely spaced relation extend parallel to each other through a portion of said transfer zone, and said cam bar extends substantially the length of the parallel forwarding and receiving power track portions.

14. A conveyor system according to claim 13 wherein said parallel forwarding and receiving power track portions are arranged in substantially symmetrical relation to a vertical plane through the longitudinal centerline of the carrier track, and said cam bar is mounted in said vertical plane.

15. A conveyor system according to claim 1, 9 or 10 wherein said positioning means comprises structure supporting the forwarding and receiving power tracks at an elevation relative to the carrier track such as to provide said limited overtaking and driving engagement between said driving dog and said forwarding and receiving pusher members.

16. A conveyor system according to claim 1, 9 or 10 wherein an actuating portion is integrally formed with said driving member, a stopping cam surface and an abutment surface are provided on said actuating portion forwardly of said driving face of the driving dog, said stopping cam surface being located forwardly of and extending to said abutment surface; a stop member, movable transversely of the carrier track and positionable in the path of movement of the driving member, is engageable by said stopping cam surface to move to and retain the driving member in non-operable position, and is engageable by said abutment surface to stop the carrier; and said stopping cam surface has adjacent to said abutment surface a transverse dimension at least as great as the transverse dimension of said abutment surface whereby said stop member is non-engageable by said abutment surface upon disengagement of said stop member from said stopping cam surface.

17. A conveyor system according to claim 16 wherein said wing portions of the driving dog are located toward the power track beyond said abutment surface and are non-abuttingly engageable by said stop member.

18. A conveyor system according to claim 1, 9 or 10 wherein there is at the transfer zone a convergence of at least one of the forwarding and receiving power tracks relative to a vertical plane through the longitudinal centerline of the carrier track; and means for preventing at said convergence lateral interference between the elements consisting of the driving member and at least one of the forwarding and receiving pusher members comprising a beveled side surface on at least one of said elements adapted to move the driving member to a non-operable position in response to the engagement of said beveled surface by the other of said elements.

19. A conveyor system according to claim 18 wherein said positioning means limits lateral engagement between said elements to the engagement of said beveled surface by the other of said elements.

20. A conveyor system according to claim 1, 9 or 10 wherein accumulating means is operably associated with said driving member of each carrier, a rearwardly extending actuator is provided on each carrier and is adapted to be engaged by said accumulating means of a following carrier for stopping such following carrier by moving the driving member thereof to said non-operable position with respect to said forwarding and receiving pusher members at said transfer zone.

21. A conveyor system according to claim 1 wherein said power track of said forwarding and receiving power conveyors is spaced vertically below said carrier track.

22. A conveyor system according to claim 21 wherein said driving trolley is provided with a pair of front and a pair of rear wheels supported on said carrier track, and front and rear guide rollers are mounted on said driving trolley, said guide rollers being engageable with guide surfaces of said carrier track and having a diameter corresponding substantially to the diameter of said wheels.

23. In a conveyor system having a carrier track, carriers each including a driving trolley supported on the carrier track, a power track mounted at a vertical spacing relative to the carrier track, carrier propelling means mounted on the power track and normally driven in a forward direction, the carrier propelling means including pusher members projecting toward the carrier track, the driving trolley having a driving member movable at said vertical spacing between operable and non-operable positions with respect to a pusher member and biased to the operable position, the improvement wherein;

the driving member is integrally formed with a driving dog and an actuating portion, the driving dog having a driving face engageable by a pusher member in the operable position of the driving member, and said actuating portion extends forwardly from the driving dog;

said driving dog includes a pair of wing portions each projecting transversely to one side of said actuating portion, and the driving face of said driving dog is provided on each of said pair of wing portions, the transverse extent of the wing portions being such that the driving face of said driving dog is engageable by forwarding and receiving pusher members of carrier propelling means mounted on a pair of power tracks arranged substantially at said vertical spacing and in transversely spaced relation at a transfer zone; and an accumulating cam surface is provided on said actuating portion, each carrier being provided with a rearwardly extending actuator adapted to be engaged by said accumulating cam surface of a following carrier for stopping such following carrier by moving the driving member thereof to said non-operable position, said driving face of said driving dog in said non-operable position of said following carrier driving member being non-engageable by each of said forwarding and receiving pusher members at said transfer zone.

24. A conveyor system according to claim 23 wherein;

a stopping cam surface and an abutment surface are provided on said actuating portion forwardly of said driving face of the driving dog, said stopping cam surface being located forwardly of and extending to said abutment surface; and a stop member, movable transversely of the carrier track and positionable in the path of movement of the driving member, is engageable by said stopping cam surface to move to and retain the driving member in non-operable position, and is engageable by said abutment surface to stop the carrier.

25. A conveyor system according to claim 24 wherein said driving trolley is provided with a holdback dog having a holdback face normally engageable by a pusher member, said driving face of the driving dog includes a portion which projects toward the power track a distance greater than said holdback face, and said abutment surface projects transversely to each side of said holdback face to prevent interference of said stop member with said holdback face.

26. A conveyor system according to claim 25 wherein said holdback dog is integrally formed with said driving member.

27. A conveyor system according to claim 24, 25 or 26 wherein said wing portions are disposed outwardly of said abutment surface toward the power track, and said stop member has a stopping surface which is engageable by said abutment surface and is non-engageable by said wing portions.

28. A conveyor system according to claim 27 wherein said stop member has an offset portion extending rearwardly and to one side of said stopping surface, said offset portion being overlappingly engageable by one of said wing portions to limit movement of the driving member to non-driving position in response to the engagement of said stop member by said stopping cam surface.

29. A conveyor system according to claim 27 wherein said actuating portion and said wing portions are provided with an anti-jam cam surface located rearwardly of said abutment surface and extending toward said driving face, said anti-jam cam surface being adapted to move the driving member toward said non-operable position in response to engagement between said anti-jam cam surface and a pusher member overtaken thereby.

30. A conveyor system according to claim 24, 25 or 26 wherein said driving member is connected to the driving trolley for movement between said operable and non-operable positions on a pivotal axis extending transversely of the carrier track;

said actuating portion includes a first arm extending rearwardly from said pivotal axis and a second arm extending forwardly from said pivotal axis;

said driving dog, said stopping cam surface and said abutment surface are formed on said first arm; and said abutment surface is provided on each of said pair of wing portions, said stopping cam surface extending to said abutment surface with an increasing transverse dimension at least as great adjacent to said abutment surface as the transverse dimension of said abutment surface.

31. A conveyor system according to claim 30 wherein motion limiting means is provided on the driving trolley, said motion limiting means being engageable by said first arm for limiting movement of the driving member to said non-operable position in response to engagement of said stop member by said stopping cam surface whereby engagement of said stop member by said abutment surface is insured.

32. A conveyor system according to claim 31 wherein said accumulating cam surface is provided on said second arm.

33. A conveyor system according to claim 23 wherein a holdback dog is integrally formed with said driving member, said holdback dog projecting toward the power track a distance less than said driving dog.

* * * * *